United States Patent [19]

Dieball

[11] 3,982,764

[45] Sept. 28, 1976

[54] ELECTRICAL GAME APPARATUS

[76] Inventor: Walter L. Dieball, 17621 Irvine Blvd., Suite 101, Tustin, Calif. 92680

[22] Filed: Apr. 30, 1975

[21] Appl. No.: 572,883

[52] U.S. Cl. ..... 273/135 A; 35/9 B; 273/1 E; 273/135 D; 273/138 A

[51] Int. Cl.[2] ..... A63F 9/00

[58] Field of Search ..... 273/1 E, 138 A, 139, 273/130 AB, 141 A, 142 B, 135 A, 135 D; 35/9 R, 9 B, 9 D, 48 R, 22 R; 40/130 E; 340/378

[56] References Cited

UNITED STATES PATENTS

| | | | |
|---|---|---|---|
| 2,133,676 | 10/1938 | Walaity | 273/139 |
| 2,870,549 | 1/1959 | Craine | 35/22 R |
| 2,893,733 | 7/1959 | O'Rourke | 273/1 E |
| 3,210,876 | 10/1965 | Towne | 40/130 E |
| 3,231,276 | 1/1966 | Cooper | 273/1 E |
| 3,252,230 | 5/1966 | Donev | 35/9 D |
| 3,261,013 | 7/1966 | Naylor | 340/378 |
| 3,367,663 | 2/1968 | Marks | 273/138 A |
| 3,795,398 | 3/1974 | Broomer | 273/138 A |

*Primary Examiner*—Richard C. Pinkham
*Assistant Examiner*—Harry G. Strappello

[57] ABSTRACT

An electrical game apparatus of chance and skill, including educational capabilities, comprising a housing having a display board adapted with a plurality of display lights arranged to provide random symbols of either numerals or letters, wherein the illumination of the display-light fixtures are controlled by the players who operate corresponding switches; and wherein there is included a rotatable mixer switch for varying the operation of the display lights with respect to the corresponding switches.

6 Claims, 3 Drawing Figures

FIG. 1
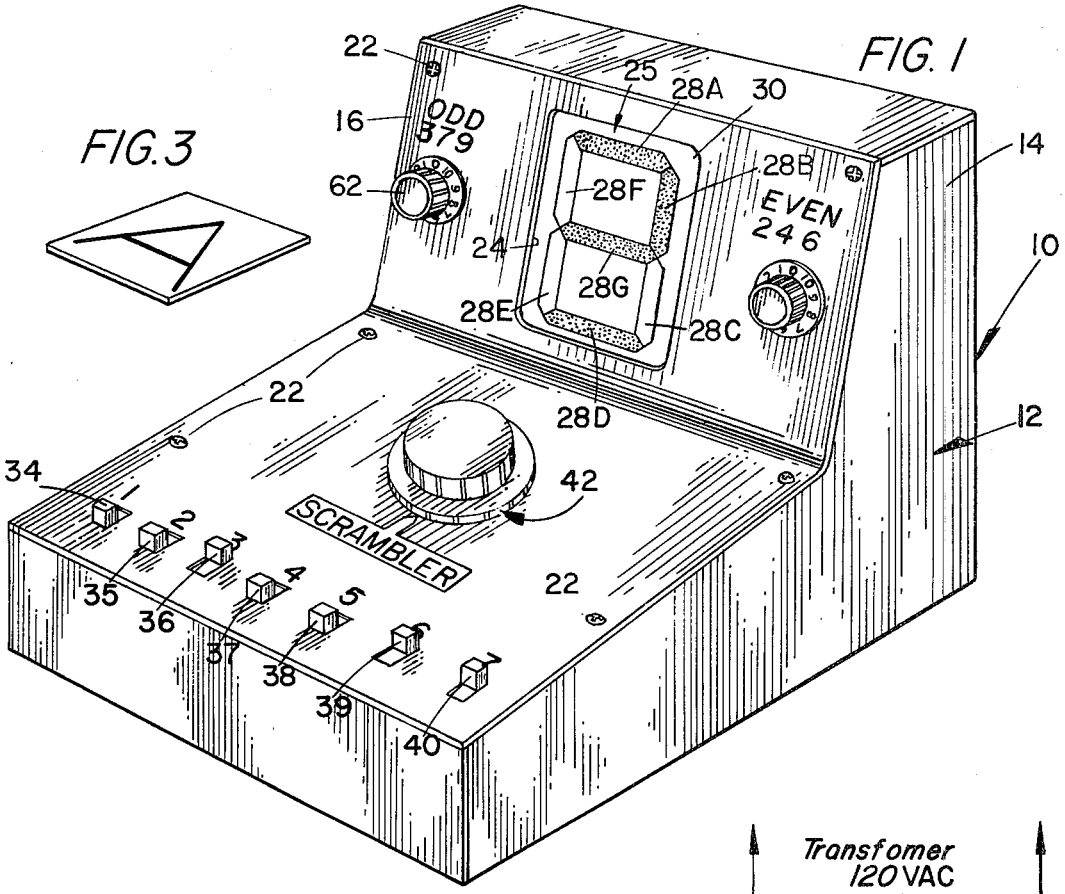
FIG. 3
FIG. 2
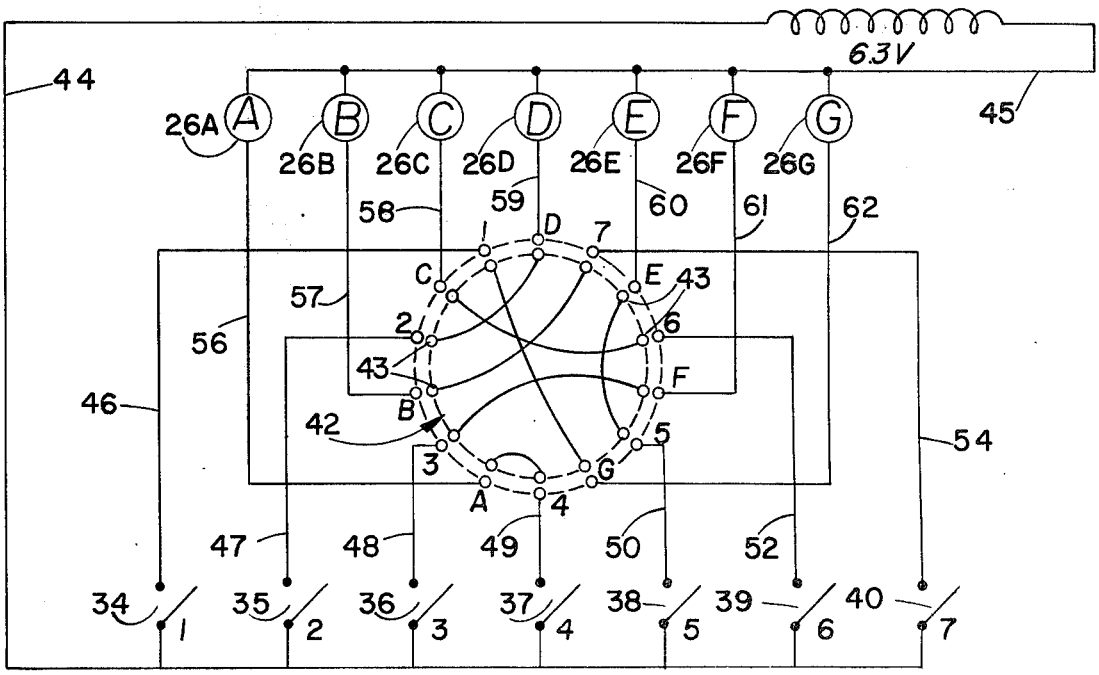

ELECTRICAL GAME APPARATUS

BACKGROUND

1. Field of the Invention

This invention relates generally to games, and relates more particularly to a game that is electrically operated by means of closing the various switches corresponding to the adjustable display lights which, when lit in a proper order, will indicate a numeral or letter.

2. Description of the Prior Art

There are various types of apparatuses for playing games. Some of these have spinable wheels and the like, some use cards, and some use ordinary dice. These games, in themselves, have various systems of play. Other types of games include varied mechanical devices and operations, such as U.S. Pat. No. 3,185,478 in which a word game is disclosed having means for winding a roll of work-indicating paper from one spool to another in conjunction with sliding tabs which represent various alphabetical letters.

Another word game disclosed in U.S. Pat. No. 3,096,092, this game being a simple mechanical apparatus using sliding tabs and a spinning wheel, which are generally found in a game board of this type.

However, U.S. Pat. No. 2,844,374 discloses an electrical guessing game that is played by two players, who must be seated at opposite sides of the game table to operate two separate groups of master switches. This game is required to be played in a particular manner which involves the lighting and extinguishing of electrical signaling lamps arranged in suitable rows. Each signaling lamp is provided with its own designated number and, when activated, the lamp readily displays its respective number disposed thereon. Hence, the structure and the functions of this game, along with the rules thereof, are different from those of the invention herein disclosed.

Thus, it can be understood that the structural elements, together with the operating mode of a game, are generally dictated by the rules that govern the manner in which a particular game is played.

SUMMARY

This invention is capable of being played in several ways under many different rules. Thus, the variety of game uses can be readily changed by the players thereof for any given game situation. However, the basic underlying feature of the present invention is to provide a single symbol — that is, either a numeral or a letter of the alphabet — which can be formed at random on a display panel. This is accomplished by the use of a plurality of display-light fixtures disposed on the display board. Each light fixture comprises a light bulb having a corresponding transparent, or translucent, elongated window which is illuminated when the bulb is activated by one of several switches. The windows are arranged in an end-to-end relationship to each other, some being positioned vertically while others are positioned horizontally, forming a substantially peripheral outline having at least one window arranged laterally within the outline thereof.

As the switches are randomly selected and activated, a corresponding bulb will light, thus illuminating a window. Due to the arrangement of the windows, various configurations can be formed by operating the right switch. With the arrangement as described, numerals zero through nine and alphabetical letters A, B, C, E, H, I, J, L, O, P, S and U can be randomly formed on the display panel. To add to the skill and chance of the game, a rotary mixer switch is included therein. This mixer switch provides a means by which electrical contacts between the light fixtures and the main switches can be changed.

As an example, after each game the mixer switch can be rotated so that each of the several main switches will activate a different light bulb than in the previous game. The preferred embodiment of the present invention contains seven master switches and seven corresponding light fixtures, the switches being located on the playing surface of the game housing below the display board which is mounted to an upright display panel. In addition, the game is provided with means for keeping score for each player, said means comprising two dials positioned on either side of the display board.

Three examples of the types of games that can be played with this electrical game apparatus will hereinafter be described, wherein letter chips or blocks are indicated.

OBJECTS AND ADVANTAGES

The present invention has for an important object the provision of an electrical game apparatus that is capable of being played under many different rules, thus providing a variety of several game situations unobtainable in most game devices.

It is another object of this invention to provide an electrical game apparatus that is simple in construction and easy to operate by small children.

It is still another object of the invention to provide an electrical game apparatus that not only includes skill and chance, but allows younger children to recognize alphabetical letters and numbers — thus becoming an educational device as well.

A still further object of the invention is to provide an apparatus of this character that is relatively inexpensive to manufacturer.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or mode of operation that are properly within the scope of the appended claim.

DESCRIPTION OF THE DRAWINGS

Referring more particularly to the accompanying drawings, which are for illustrative purposes only;

FIG. 1 is a perspective view of the electrical game apparatus, showing the construction of the housing and layout of the game panel switch board;

FIG. 2 is an electrical diagram illustrating the electrical connection between the master switches and the light bulbs, with the rotary mixer switch operably disposed within the circuit thereof; and FIG. 3 is a perspective view of one of the many chips marked with an alphabetical letter on the face thereof.

DESCRIPTION OF THE PREFERRED EMBODIMENT

Referring more particularly to the drawings, there is illustrated in FIG. 1 an electrical game apparatus, generally indicated at 10, comprising a housing 12 having a substantially L-shaped configuration. The vertical rear portion 14 is provided with a front face cover 16 which will be hereinafter referred to as a "display panel", the display panel being integral with a substantially flat, horizontal plate 18, hereinafter referred to as the "switch panel". Switch panel 18 provides a cover for the lower, horizontal portion 20 of the housing 12. The cover plates 16 and 18 are secured to the housing 12 by screws 22; however, other suitable fastening means can be employed thereon.

The display panel 18 includes a substantially rectangular aperture 24 which provides an opening through which a plurality of light fixtures are displayed, said light fixtures being indicated generally by numeral 25. As illustrated in the present invention, there are seven light fixtures, wherein each of the fixtures comprises a light bulb 26A, 26B, 26C, 26D, 26 E and 26F and corresponding transparent, or translucent, windows 28A, 28B, 28C, 28D, 28E and 28F, respectively. These fixtures are mounted to a display board 30 which is secured to the display panel 16, whereby the windows are exposed within the aperture 24. Light fixtures 25 are so arranged on the display board 30 as to form a peripheral outline having a substantially rectangular shape similar to aperture 25, wherein windows 28A through 28F are arranged in an end-to-end manner having window 28A located at the top of the rectangular outline in a horizontal position; and wherein window 28B adjoins the end of window 28A in a vertical manner, forming a portion of the vertical side thereof. Window 28C depends downwardly from window 28B, thus completing the right vertical side of the rectangular outline. Disposed horizontally along the bottom is window 28D which is adjoined at one end by window 28C, and at the opposite end by window 28E which is arranged vertically, forming the left side along with vertical window 28F. At this point, the rectangular outline is formed. However, the window 28G is included therein and is centrally disposed in a horizontal position, joining at its opposite ends to the respective vertical windows — thereby providing additional letters or numerals that can be formed therewith when said bulbs are caused to be lit.

In order to electrically operate the game, it must be provided with a power source, which could be either a battery or, as shown, a transformer 32 so that the game can be connected to any home outlet having 120V AC system. The transformer converts said 120V AC to a compatible DC voltage of approximately 6.3 V, as indicated in FIG. 2.

In both FIGS. 1 and 2 there is illustrated a plurality of master switches indicated by numerals 34, 35, 36, 37, 38, 39 and 40. There are seven master switches to correspond to the seven light fixtures.

Included within the operation of the game and the circuitry thereof is a rotary switch which will be referred to as a "mixer" or "scrambler" switch 42. The mixer switch is electrically positioned between the master switches 34–40 and the light bulbs 28A–28G, and is provided with a first group of contacts having two sets of 14 contacts which are stationary, and a second group of 14 contacts which rotate with respect to the stationary contacts. Seven of the stationary contacts marked 1, 2, 3, 4, 5, 6 and 7 are electrically connected to the respective master switches 34, 35, 36, 37, 38, 39 and 40, wherein the remaining stationary contacts are marked A, B, C, D, E, F and G, and these are connected to light bulbs 26A, B, C, D, E, F and G, respectively.

The fourteen rotary contacts 43 are connected in pairs to each other, as shown in FIG. 2, thereby providing a multiplicity of various connections between the master switch and their corresponding light bulbs. Thus, as an example, when switch 34 is closed light bulb 26G will light, thereby causing window 28G to be iluminated on the display panel. By closing switch 37, window 28A will light up, and the switch will light window 28D, while closing switch 39 and 40 these windows, when lighted by their respective switches, will form a numeral 3, as shown in FIG. 1.

A still further description of the electrical circuit is as follows:

Line 44 leads from one side of the transformer 32 and connects to one side of master switches 34 – 40, and line 45 connects the light bulbs 26A – 26G. Line 46 connects switch 34 to stationary contact 1, switch 35 being connected to contact 2 through line 47; line 48 connects contact 3 with switch 36; line 49 connects contact 4 to switch 37; line 50 connects switch 38 to contact 5; switch 39 connects contact 6 by way of line 52; and the last switch 40 is connected to contact 7 through line 54. Light bulbs 26A, 26B, 26C, 26D, 26E, 26F and 26G are respectively connected to stationary contacts A, B, C, D, E, F and G through respective lines 56, 57, 58, 59, 60, 61 and 62; therefore, rotating contacts can randomly interconnect the switches to close the circuit when any one master switch is closed.

Accordingly, if the right combination of master switches are closed, any number from 0 to 9 can be formed on the display panel, or any of the following letters can be formed: A, B, C, D, E, F, H, I, J, L, O, P, S and U.

EXAMPLES OF GAMES

Game No. 1 — Numbers and Letters

This game is played by two players — one player taking the odd numbers and the other player taking the even numbers. The player having the even numbers is assigned scoring dial 60 located to the right of aperture 24 in the display panel 16, and the player having the odd numbers uses the scoring dial 62, each dial being marked from 1 to 10 for scoring.

The "odd" player starts the game by turning on one of the seven switches. The "even" player then turns on a second switch and the game continues with each player alternately taking turns operating the switches, one at a time, until a letter or number is formed on the display board. The player who first completes a letter or number scores a point which is registered on his assigned score dial.

The exception to the above rule is as follows:

If the number 3, 7 or 9 is formed, the point goes to the odd player; and if the number 2, 4 or 6 is formed, the point goes to the even player, regardless of who formed it. However, any letter that is formed scores a point for the player who formed it.

After a point is scored, all of the switches are turned off, and a new round is started. The loser of the last round plays first in a new round. The first player to score 10 points, wins the game.

After a few rounds of play, the players will begin to remember which switch controls which segment of the digit, making it easier to form letters and numbers. However, to prevent a player from memorizing all the switches and thereby winning too easily, there is a scrambler (represented by mixer switch 42) which, when turned, changes the connections between the switches and the light segments of the digit. This means that the switches will turn on different segments or windows of the display then were turned on previously.

The scrambler may be turned after each game, or after every other game — whichever is decided prior to playing. If one player gets behind his opponent by five or more points, he may turn the scrambler switch — if he thinks it will help him win the game.

Game No. 2 — Three Little Words

This game may be played by any number of people. The play is the same as before, with players taking turns operating the switches to form letters. Numbers have no value in this game.

Using the letter blocks 65, as shown in FIG. 3, when a player completes a letter on the display board, he takes the matching letter block from the pot and keeps it in front of him. A new round is then started by the next player to the left.

The play continues until enough letters are collected to form words. The first player to form three words, of three or more letters each, wins the game.

In order to get letters which cannot be formed on the game, a player may exchange three unwanted letters for one which he needs to complete a word. The scrambler switch may be turned after each word is formed.

Game No. 3 — High Score

Any number of players can play, using only the numbers formed on the digit.

Players take turns operating the switches to try to form numbers. When a number is completed by a player, it is written on a tally sheet and added to his previous score. The first player to reach 50 points is the winner. The scrambler switch may be turned by the player with the lowest score, if he gets 20 or more points behind. This may be done only once per game by each player.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. An electrical game apparatus comprising:

a housing having a display panel and a switch panel;

a plurality of light fixtures mounted for display in said display panel, wherein each of said light fixtures comprises:

an elongated window member; and a light bulb positioned adjacent thereto, whereby said window is illuminated when said bulb is activated;

a plurality of master switches, equal to the number of said light fixtures, electrically connected thereto and mounted to said switch panel;

means for randomly changing the electrical connection between said light fixtures and said master switches, said means being mounted to said switch panel thereof, and comprises a rotary mixer switch having a plurality of stationary contacts and an equal number of rotatable contacts for random engagement therebetween; and wherein each window is arranged to form a peripheral outline of a substantially rectangular configuration, said windows being disposed in an ene-to-end relationship, and having at least one window centrally positioned horizontally within said peripheral outline thereof, whereby numeral and alphabetical letters can be formed thereby when proper lighting fixtures are illuminated during the playing of said game apparatus.

2. An electrical game apparatus as recited in claim 1, wherein said game apparatus is provided with seven light fixtures, and wherein said peripheral outline is formed by a pair of vertical opposing sides, each side thereof including a pair of end-to-end windows, a single top-and-bottom window positioned horizontally between the vertical side windows at the respective upper and lower ends thereof, and a single horizontal window disposed intermediate the ends of said vertical sides.

3. An electrical game apparatus as recited in claim 2, wherein said game apparatus includes seven master switches to correspond to said seven light fixtures, and wherein said rotary mixer switch includes a seven-pole, fourteen-position, rotary assembly whereby rotation thereof changes the electrical connection between each of said bulbs and each of said master switches.

4. An electrical game apparatus as recited in claim 3, wherein numerals from 0 to 9 can be randomly formed, and wherein alphabetical letters A, B, C, E, F, H, I, J, L, O, P, S and U can be randomly formed.

5. An electrical game apparatus as recited in claim 4, wherein said light fixtures are supported in a display board, and wherein said display board is mounted to said display panel, said display panel being substantially vertical to said switch board.

6. An electrical game apparatus as recited in claim 5, wherein said game apparatus includes a pair of score-keeping dials disposed on said display panel.

* * * * *